US012134862B2

(12) United States Patent
Yasui et al.

(10) Patent No.: US 12,134,862 B2
(45) Date of Patent: Nov. 5, 2024

(54) TOILET PAPER AND METHOD FOR PRODUCING TOILET PAPER

(71) Applicant: Daio Paper Corporation, Ehime (JP)

(72) Inventors: Shuta Yasui, Shizuoka (JP); Minoru Iwasaki, Shizuoka (JP)

(73) Assignee: Daio Paper Corporation, Ehime (JP)

( * ) Notice: Subject to any disclaimer, the term of this patent is extended or adjusted under 35 U.S.C. 154(b) by 0 days.

(21) Appl. No.: 17/442,696

(22) PCT Filed: Feb. 12, 2020

(86) PCT No.: PCT/JP2020/005223
§ 371 (c)(1),
(2) Date: Sep. 24, 2021

(87) PCT Pub. No.: WO2020/195259
PCT Pub. Date: Oct. 1, 2020

(65) Prior Publication Data

US 2024/0209576 A1 Jun. 27, 2024

(30) Foreign Application Priority Data

Mar. 27, 2019 (JP) ..... 2019-061937

(51) Int. Cl.

| | |
|---|---|
| ***D21H 27/30*** | (2006.01) |
| ***D21H 17/14*** | (2006.01) |
| ***D21H 21/22*** | (2006.01) |
| ***D21H 27/00*** | (2006.01) |

(52) U.S. Cl.
CPC ..... *D21H 27/30* (2013.01); *D21H 17/14* (2013.01); *D21H 21/22* (2013.01); *D21H 27/004* (2013.01)

(58) Field of Classification Search
CPC ..... D21H 27/30; D21H 17/14; D21H 21/22; D21H 27/004; D21H 17/07
See application file for complete search history.

(56) References Cited

U.S. PATENT DOCUMENTS

| | | | | |
|---|---|---|---|---|
| 6,544,912 | B1 | 4/2003 | Tanio et al. | |
| 2007/0233024 | A1 * | 10/2007 | Uehara | D21H 27/002 719/332 |
| 2020/0032459 | A1 | 1/2020 | Yasui | |

FOREIGN PATENT DOCUMENTS

| | | | | |
|---|---|---|---|---|
| CN | 1315209 | A | | 10/2001 |
| JP | 05148794 | A | * | 6/1993 |
| JP | 2008-075198 | A | | 4/2008 |
| JP | 2010126860 | A | * | 6/2010 |
| JP | 2011-153387 | A | | 8/2011 |
| JP | 2018-057453 | A | | 4/2018 |
| WO | 2005/118954 | A1 | | 4/2008 |
| WO | 20180691309 | A1 | | 4/2018 |

* cited by examiner

*Primary Examiner* — Dennis R Cordray
*Assistant Examiner* — Matthew M Eslami
(74) *Attorney, Agent, or Firm* — Renner, Kenner; Arthur M. Reginelli

(57) ABSTRACT

To provide a toilet paper that provides an excellent thick feeling, has excellent water-disintegrability, has sufficient softness, provides a security feeling to a human body during use, and is environmentally friendly. The problem is solved by a 3-ply or 4-ply toilet paper having a basis weight of 10.5 to 16.5 g/m$^2$ per ply, containing softwood-derived pulp in an amount of 80% by mass or more of fibers, containing a cationic fatty acid amide-based softener, and having a disintegration freeness of 550 cc or more.

5 Claims, 4 Drawing Sheets

(A)

(B)

TOILET PAPER AND METHOD FOR PRODUCING TOILET PAPER

TECHNICAL FIELD

The present invention relates to a toilet paper and a method for manufacturing the toilet paper.

BACKGROUND ART

In a toilet paper, a wiping property may be required when a shower toilet, which is also called a toilet with a washing function, is used (Patent Literature 1 below).

It is desirable that a toilet paper suitable for the shower toilet is a multi-ply product such as a 3-ply or 4-ply product because it is easy for a consumer to obtain a security feeling during use of thereof.

In such a multi-ply product, by assuming use particularly in a shower toilet, and placing importance on a balance between touch when a toilet paper is pressed against the skin and strength during of use, a toilet paper containing 60 to 70% by mass of good hardwood pulp that has a short fiber length and easily makes a surface property of the paper surface favorable has been generally used.

CITATION LIST

Patent Literature

Patent Literature 1: JP 2011-153387 A

SUMMARY OF INVENTION

Technical Problem

However, the multi-ply product may be often used in situations where the shower toilet is not used. In such a case, particularly, the multi-ply product has an excellent surface property, but does not necessarily exhibit a sufficient wiping property although providing good touch when stool adhering to the vicinity of the anus is wiped off during defecation. In particular, strength in a case of hard stool and a wiping property in terms of a surface property may be insufficient.

Therefore, a main object of the present invention is to provide a toilet paper that provides a thick feeling that can make a user reassured during use thereof in a shower toilet, has softness, has a favorable surface property, and has an excellent property of wiping off stool adhering to the skin, and a method for manufacturing the toilet paper.

Solution to Problem

A first means to solve the above problems is a 3-ply or 4-ply toilet paper, each ply having a basis weight of 10.5 to 16.5 g/m$^2$, containing softwood-derived pulp in an amount of 80% by mass or more of fibers, containing a cationic fatty acid amide-based softener, and having a dissociation freeness of 550 cc or more.

A second means is the toilet paper according to the first means, containing 0.5 to 4.0 kg/pulp t of the cationic fatty acid amide-based softener.

A third means is a 3-ply or 4-ply toilet paper obtained by stacking three or four 1-ply sheets each obtained by performing a papermaking of raw material containing softwood-derived pulp in an amount of 80% by mass or more of fibers and 1.0 to 8.0 kg/pulp t of a cationic fatty acid amide-based softener, and having a raw material freeness of 600 cc or more, and each having a basis weight of 10.5 to 16.5 g/m$^2$.

A fourth means is a method for manufacturing a toilet paper, the method including:

performing a papermaking of raw material containing softwood-derived pulp in an amount of 80% by mass or more of fibers and 1.0 to 8.0 kg/pulp t of a cationic fatty acid amide-based softener, and having a freeness of 600 cc or more to obtain a single layer sheet having a basis weight of 10.5 to 16.5 g/m$^2$, and then stacking three or four of these single layer sheets.

Advantageous Effects of Invention

The present invention described above provides a toilet paper that provides a thick feeling that can make a user reassured during use thereof in a shower toilet, has softness, has a favorable surface property, and has an excellent property of wiping off stool adhering to the skin, and a method for manufacturing the toilet paper.

DESCRIPTION OF EMBODIMENTS

Figure 1:
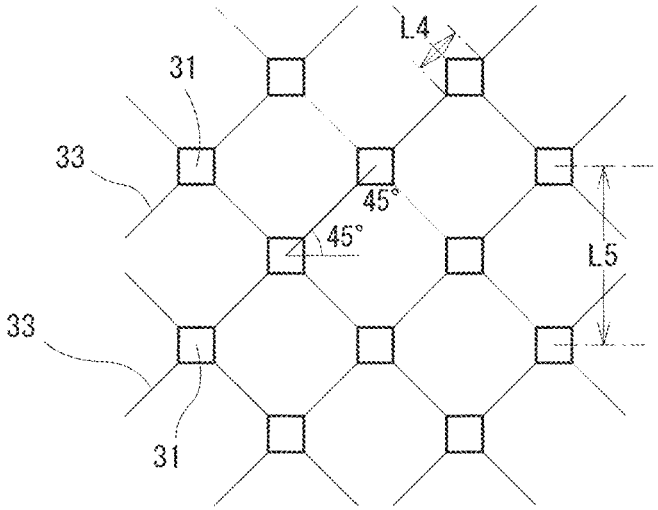
FIG. 1 is a plan view of an embossment according to an embodiment of the present invention.
Figure 1:
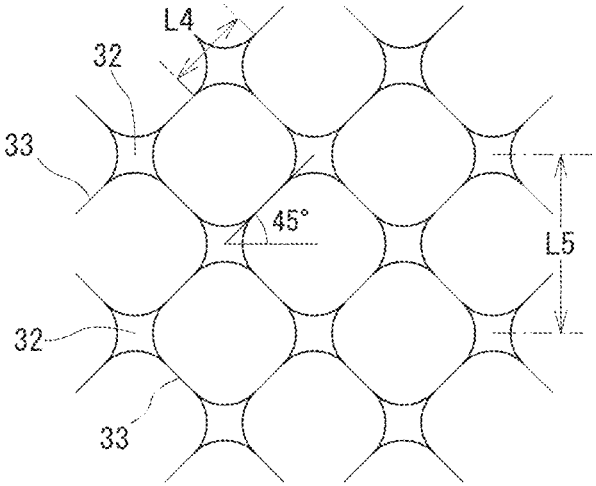

A toilet paper according to the present embodiment is a 3-ply or 4-ply product. That is, three or four sheets are stacked. When the toilet paper is a product of multi-ply exceeding 2-ply, such as a 3-ply or 4-ply product, the paper thickness of the entire paper is large while each ply is thin, and the paper can be hardly torn and can provide a security feeling while particularly "softness" is easily felt.

Note that a 2-ply product hardly exhibits a thick feeling, and is likely to provide a poor security feeling when the paper absorbs a large amount of water and wipes the water after use in a shower toilet. In addition, when the toilet paper is a 5 or more-ply product, even if each ply is thin, softness is hardly felt when the skin is wiped with the toilet paper. In addition, in the basis weight and the paper thickness per ply according to the present invention described later, when a 5 or more-ply product is used, strong rigidity is felt, and softness is hardly felt.

On the other hand, in the toilet paper according to the present embodiment, the basis weight per ply is 10.5 g/m$^2$ or more and 16.5 g/m$^2$ or less. The basis weight per ply is preferably 12.5 g/m$^2$ or more and less than 16.0 g/m$^2$, and more preferably 13.5 g/m$^2$ or more and 15.5 g/m$^2$ or less. If the basis weight per ply is within this range, sufficient difficulty in tearing and softness can be exhibited when the above 3-ply or 4-ply product is used. In addition, water-disintegrability is easily exhibited. Note that the basis weight according to the present invention is measured by the basis weight measuring method of JIS P 8124 (1998).

On the other hand, the toilet paper according to the present invention contains softwood-derived pulp in an amount of 80% by mass or more of constituent fibers. The toilet paper according to the present invention particularly preferably contains softwood-derived pulp in an amount of substantially 100% by mass without considering impurities and the like. The softwood-derived pulp is not limited. Examples thereof include: softwood kraft pulp called NOKP, manufactured by continuously oxygen-pulping fibers in a continuous pulping pot, softwood kraft pulp called NBKP, manufactured by continuously oxygen-pulping fibers in a continuous pulping pot, and bleaching the fibers with a chlorine-based bleaching agent such as chlorine, chlorine dioxide, or sodium hypochlorite; and unbleached softwood pulp called NUKP, manufactured in a continuous pulping pot without bleaching fibers. Furthermore, softwood pulp derived from used paper may be used. These types of softwood-derived pulp may be mixed as long as the pulp is derived from softwood. Softwood-derived pulp has a longer fiber length than hardwood-derived pulp, and therefore is less likely to generate paper dust.

Among the types of softwood-derived pulp, NOKP is the most preferable, NUKP is particularly preferable, and NBKP is preferable. In NOKP and NUKP, lignin remains in pulp. In NOKP, fibers are oxygen-pulped (oxygen-delignified), but about half the amount of lignin remains. Pulp in which lignin remains is light brown, is likely to give a visual impression of a natural product that has not been chemically treated, and gives a soft impression. Therefore, a user or a purchaser feels a large security feeling. In addition, since lignin is not hydrophilic, pulp containing lignin has a low fiber swelling property and a weak interfiber bond than fibers made of a bleached raw material containing no lignin. Therefore, fibers are likely to be sparse, and water-disintegrability is more favorable. Furthermore, an excellent cushioning property is exhibited in combination with the action of lignin to prevent fibers from being dense.

In addition, since the content of lignin in NOKP has been reduced to about half of that before oxygen-pulping. Therefore, NOKP exhibits softness more easily than NUKP that has not been delignified at all, and is easily adjusted to a sufficient strength.

Fiber components other than softwood pulp are not necessarily limited, but hardwood-derived pulp is desirable. Hardwood-derived pulp has a short fiber length, and a surface thereof is easily smoothed. Examples of hardwood-derived pulp include: hardwood kraft pulp called LOKP, manufactured by continuously oxygen-pulping fibers in a continuous pulping pot, hardwood kraft pulp called LBKP, manufactured by continuously oxygen-pulping fibers in a continuous pulping pot, and bleaching the fibers with a chlorine-based bleaching agent such as chlorine, chlorine dioxide, or sodium hypochlorite; and unbleached hardwood pulp called LUKP, manufactured in a continuous pulping pot without bleaching fibers. LOKP and LUKP each have a light brown appearance, and are likely to give a visual impression of a natural product that has not been chemically treated.

As a fiber component, virgin pulp or used paper pulp may be used. In a step of regenerating pulp from used paper, fibers in used paper pulp tend to be finer than pulp fibers before regeneration, and due to such a nature of the fibers, the fibers easily become dense without increasing a paper thickness, and paper strength easily increases. Meanwhile, if an excessive amount of used paper pulp is blended, texture such as flexibility is reduced. Therefore, in consideration of the characteristics of used paper pulp, the blending ratio thereof is preferably set within a range of 0 to less than 20% by mass. The type of used paper pulp is not necessarily limited. Examples thereof include milk carton used paper and high-quality used paper It is desirable that a moisturizer that increases the water content in paper by its hygroscopic action or oil and fat are not externally applied to the toilet paper according to the present invention. Examples of the externally added moisturizer include glycerin, diglycerin, propylene glycol, 1,3-butylene glycol, and polyethylene glycol. However, the above component may be contained as long as the content of the above component is at a level not being worthy of a moisturizing toilet paper. When a moisturizer or oil and fat are externally applied to the toilet paper, stickiness and moist feeling are felt. Therefore, it may be recognized that the paper contains a chemical agent, and a user's security feeling is not necessarily improved sufficiently.

The toilet paper according to the present invention contains a softener that determines softness and paper strength of a base paper itself, the softener being internally added during papermaking. The softener contained in the toilet paper according to the present invention is a cationic fatty acid amide-based softener. The cationic fatty acid amide-based softener acts to coat surfaces of fibers. In addition, an effect is not reduced by inclusion of lignin, and even if the toilet paper contains a large amount of pulp containing lignin, the toilet paper has a smooth surface, remarkably reduces a stiff feeling, and enhances a fullness. The cationic fatty acid amide-based softener is not necessarily limited, but specific examples thereof include a reaction product between an amide-based compound obtained by a reaction between a polyalkylene polyamine and a monocarboxylic acid, and epihalohydrin. An effect is easily exhibited if this cationic fatty acid amide-based softener is used. Note that when the reaction product between an amide-based compound obtained by a reaction between a polyalkylene polyamine and a monocarboxylic acid, and epihalohydrin is internally added, the product is preferably mixed with an emulsifier having an alkyl group and/or an alkenyl group having 4 to 20 carbon atoms, and water and added. The content of the cationic fatty acid amide-based softener is not necessarily limited, but it is desirable that the content is 0.5 to 4.0 kg/pulp t. Note that in order to set the content of the cationic fatty acid amide-based softener to 0.5 to 4.0 kg/pulp t, it is preferable to contain 1.0 to 8.0 kg/pulp t of the cationic fatty acid amide-based softener in a papermaking raw material. Since a fixing ratio of the cationic fatty acid amide-based softener is 50 to 60%, it is only required to add the cationic fatty acid amide-based softener in the papermaking raw material within the above range.

Furthermore, it is desirable that a softening moisturizer is internally added to the toilet paper according to the present invention. It is desirable that the content thereof is 0.2 to 2.0 kg/pulp t. By inclusion of the softening moisturizer, suppleness is improved. A particularly preferable softening moisturizer is a reaction product obtained by causing a compound obtained by adding an alkylene oxide having 2 to 4 carbon atoms to active hydrogen of a polyalkyleneimine having a weight average molecular weight of 500 to 10,000 to react with a higher fatty acid having 12 to 24 carbon atoms and/or an ester compound of a higher fatty acid having 12 to 24 carbon atoms. By inclusion of this softening moisturizer, softness is further improved.

The toilet paper according to the present invention has a high disintegration freeness of 550 cc or more, and contains fibers derived from an unbeaten or low beaten fiber raw material. Note that the disintegration freeness is preferably 580 cc or more, and particularly preferably 590 cc or more. When the fibers are unbeaten or low beaten, the fibers are less likely to be entangled with each other, resulting in a high disintegration freeness value according to the present invention. In other words, as the fiber components of the toilet paper according to the present invention, unbeaten or low beaten fibers having a disintegration freeness of 550 cc or more are contained. If the disintegration freeness is 550 cc or more, water-disintegrability is favorable. In addition, in the unbeaten or low beaten fibers having a disintegration freeness of 550 cc or more, a thick trunk portion remains because fibrillation on surfaces of the fibers has not progressed. The toilet paper according to the present invention has an excellent property of wiping off stool adhering to the skin because fibers include a thick trunk portion for which fibrillation has not progressed on surfaces thereof. In particular, the toilet paper according to the present invention contains softwood-derived pulp having a long fiber length in an amount of 80% by mass or more of fibers. Therefore, in a case where the fibers are unbeaten or low beaten, the toilet paper has a particularly excellent property of wiping off hard stool adhering to the skin. In addition, the toilet paper has excellent softness and provides a favorable fullness due to an effect of the softener internally added and moderate entanglement between the fibers. Moreover, paper dust is also extremely unlikely to be generated.

Here, the disintegration freeness according to the present invention is measured as follows. Note that as for the number of times of measurement, measurement is performed twice for the same sample, and an average value thereof is defined as a measured value. When the two measured value are different from the average value by 2% or more, an additional test is performed.

(Disintegration of Toilet Paper)

A sheet (toilet paper) is torn into a size of about 2 cm by hand, and 30±0.5 gg of the sheet in an absolute dry condition is prepared. 30±0.5 g of the torn sheet is immersed in 2000 mL of water for four hours or more (concentration 1.5% by mass). Note that the water temperature at this time is 20±5° C.

After a lapse of four hours or more, all of 30±0.5 g of the sheet and 2000 mL of water are put in a standard disintegration machine. After the water temperature is checked, the sheet is disintegrated for 10 minutes.

After a lapse of 10 minutes, a spatula of the resulting liquid is collected in a graduated cylinder and diluted with water, and it is visually checked whether the fibers are disintegrated. When sufficient understanding is checked, the following freeness measurement is performed on the disintegrated solution. When disintegration is insufficient, disintegration is performed again. At this time, it is visually checked whether the fibers are disintegrated at intervals of two to three minutes in a similar manner to the above, and the operation is repeated until the fibers are disintegrated. However, this is performed for 30 minutes at maximum. In this way, the fibers can be defibrated with almost no change in the original properties of the fibers. Note that a disintegration count 1230 rpm of the standard disintegration machine is a count value when the disintegration machine is operated for 10 minutes.

(Freeness Measurement)

Using the following Canadian standard freeness tester, measurement is performed according to the Canadian standard freeness test (JIS P 8121-2 2012) as described below. For the Canadian standard freeness tester, one with the following specifications or its equivalent machine is used.

A filtered water bottle is, for example, a copper cylinder, and a sieving plate (a disk having 97 holes each having a diameter of 0.5 mm per $cm^2$) is set on a bottom of the cylinder. A hole diameter of a cock for injecting air is 4.8 mm. A measuring funnel is made of, for example, brass, has an upper opening diameter of 203 mm, has a maximum length of 278 mm, has a main cone apex angle of 29.5±0.5°, and is machine-finished. In addition, the funnel has a precisely machine-finished bottom hole in a bottom thereof, and has a side tube on a side surface thereof. The minimum diameter of the bottom hole is 3.1 mm and is adjusted such that 530±5.3 mL of water is discharged per minute when 725±5 mL (20±5° C.) of water per minute is supplied to the funnel. The side tube is a hollow tube having an inner diameter of 12.7 mm and penetrates a wall surface of the funnel. The amount of water between the bottom of the funnel and an overflow water level is set to 23.5±0.2 mL.

Next, from the disintegrated solution obtained by the above "(Disintegration of toilet paper)", a measuring solution having a solid content concentration of 0.3% by mass is prepared as follows.

First, the disintegrated solution obtained by the above "(Disintegration of toilet paper)" is diluted so as to have a concentration of 0.3 to 1.0% by mass. About 500 g of the diluted sample is collected, put in a container for mass weighing, and weighed with an accuracy of 0.5 g or less (weighing value A).

Next, No. 2 filter paper is put in a hot air dryer (105±2° C.), dried until the filter paper reaches a constant weight, and weighed with an accuracy of 0.01 g (weighing value B).

The above No. 2 filter paper is set in a Buchner funnel and moistened with water, and suction is started. Next, about 500 g of the collected sample is transferred to the Buchner funnel, and water is sucked. After the suction is completed, the No. 2 filter paper on which the fibers are placed is taken out, caused to pass through a sheet dryer set at 120° C. twice, put in a hot air dryer (105±2° C.) for 10 minutes, and then taken out. The mass of the taken out No. 2 filter paper on which the fibers are placed is weighed with an accuracy of 0.01 g (weighing value C).

After the weighing values A to C are determined as described above, the solid content concentration X (% by mass) of the sample is calculated by the following formula (rounding width is 0.01).

$$\text{Solid content concentration } X = (((\text{weighing value } C) - (\text{weighing value } B))/(\text{weighing value } A)) \times 100$$

Based on the calculated solid content concentration X (% by mass), the collection amount D of the diluted disintegrated solution is determined by the following calculation formula such that 3 g of absolute dry pulp is contained.

$$\text{Collection amount } D \text{ (g)} = 300/X$$

D (g) of a disintegrated solution containing 3 g of absolute dry pulp is put in a 1000 mL graduated cylinder and diluted to 1000 mL to prepare a measurement solution having a solid content concentration of 0.3% by mass. The temperature at this time is measured with an accuracy of 1° C.

Next, the prepared measurement solution is measured using the Canadian standard freeness tester described above. Note that when the measurement solution is poured into the tester, an opening of the graduated cylinder is closed with the palm, and the graduated cylinder is turned upside down about three times to be stirred. Five seconds after the measurement solution is poured, the filtered water is caused to flow down.

When drainage of the side pipe is stopped, the mass of the amount of drainage from the side pipe is weighed with an accuracy of 0.1 g, and the mass is converted into volume (mL). Next, the measured value is corrected to freeness at the standard temperature of 20° C. based on JIS P 8121-2 2012 Annex D "Freeness correction table to temperature of 20° C." and the water temperature of the measurement solution. An average of these numerical values corrected to the temperature of 20° C. is defined as disintegration freeness. Note that an accuracy is 1 mL. When the concentration does not reach exactly 0.3% by mass, the concentration is corrected according to JIS P 8121-2 2012 Annex C "Freeness correction table to concentration of 0.30%".

Here, in order to set disintegration freeness to 550 cc or more, it is only required to use unbeaten or low beaten fibers for the fibers in the papermaking raw material as described above. The specific beating degree of a papermaking raw material during manufacturing is not necessarily limited, but it is only required to beat the papermaking raw material such that a down width of the Canadian standard freeness is 0 cc to 50 cc. This down width is much smaller than the beating width of a general papermaking raw material. In this case, the Canadian standard freeness of the papermaking raw material is approximately 600 cc or more. In this way, the pulp fibers are preferably unbeaten or low beaten. Within this range, when the above softener is internally added, the softener is fixed to surfaces of the fibers, and the fibers are entangled with each other, resulting in excellent softness and a favorable fullness. Moreover, paper dust is extremely unlikely to be generated. It is desirable that softwood-derived pulp has a high roughness because it is easy to increase the freeness and the disintegration freeness of the papermaking raw material.

On the other hand, it is desirable that the toilet paper according to the present invention has a paper thickness of 80 to 160 μm per ply, and has a paper thickness of 320 to 560 μm as the entire toilet paper. When the paper thickness is within this range, an excellent fullness, excellent softness, and a reassuring thick feeling can be provided. The paper thickness of the toilet paper is obtained by sufficiently (usually for about eight hours) subjecting a test piece to humidity control under conditions of JIS P 8111 (1998), and then measuring the paper thickness in a 1-ply state using a dial thickness gauge (thickness measuring instrument) "PEACOCK G type" (manufactured by Ozaki MFG. Co. Ltd.) under the same conditions. Specifically, it is confirmed that there is no rubbish, dust, or the like between a plunger and a measuring table, the plunger is placed on the measuring table, a scale of the dial thickness gauge is moved to adjust a zero point, then the plunger is raised, a sample is placed on a test table, the plunger is lowered slowly, and the current gauge is read. When the toilet paper is embossed, measurement is performed such that one constituent concave (convex) is necessarily within a range of the measuring table. Note that when there are concaves with different depths, measurement is performed such that the deepest concave (convex) is located within the range of the measuring table. During this measurement, the plunger is only placed and not pressed. A terminal of the plunger is made of metal, and a circular plane thereof with a diameter of 10 mm strikes perpendicularly to a paper plane, and a load is about 70 gf when the paper thickness is measured. Note that the paper thickness is an average of values obtained by performing the measurement 10 times. Here, when the paper thickness is measured, crushing of an embossment (concave) is assumed, but the paper thickness according to the present invention is a value measured including such crushing, and such crushing may be ignored. In the present paper thickness measurement, a difference in paper thickness caused by crushing of a concave can be ignored. The paper thickness can be further adjusted with a crepe ratio.

The toilet paper according to the present invention may be embossed. An emboss pattern thereof is not necessarily limited. An embossment can be an appropriate emboss pattern such as a micro-embossment, a dot-shaped embossment, or a design embossment. However, it is desirable that the emboss pattern according to the present invention is a 4-ply double embossment formed by 2-ply stacked single embossed sheets, or an embossment formed by combining a 2-ply stacked single embossed sheet and a 1-ply embossed sheet.

A suitable emboss pattern according to the present invention has a concave area of 1.0 to 2.5 $mm^2$, a density of 5.0 to 50 pieces/$cm^2$, and an embossment depth of 0.05 to 0.5 mm. Softness of the toilet paper is improved, and softness in a rolled state like a toilet roll is increased, which makes a consumer easily feel that the toilet paper is soft when the consumer holds the toilet paper in his/her hand. In particular, as illustrated in FIG. 1, on the entire surface of paper, square concaves 31 (FIG. 1A) in each of which a bottom surface is diagonal L4×diagonal L4=1.0 to 1.5×1.0 to 1.5 mm or substantially square concaves 32 (FIG. 1B) obtained by extending corners of the squares diagonally outward are arranged in a lattice with a center spacing L5 of 4.5 to 5.5 mm and an arrangement angle of 45° with respect to a width direction, and there is a valley line portion 33 extending from each of the corners of the concave between the concave 31 (32) and the concave 31 (32). Note that it is desirable that the valley line portion 33 is gradually gently formed in a cross-sectional arch such that the valley line portion 33 is deepest in the corners of the concave 31 (32) and shallowest in the middle between the concaves. This emboss pattern is excellent in softness and a stool wiping property.

Figure 2:
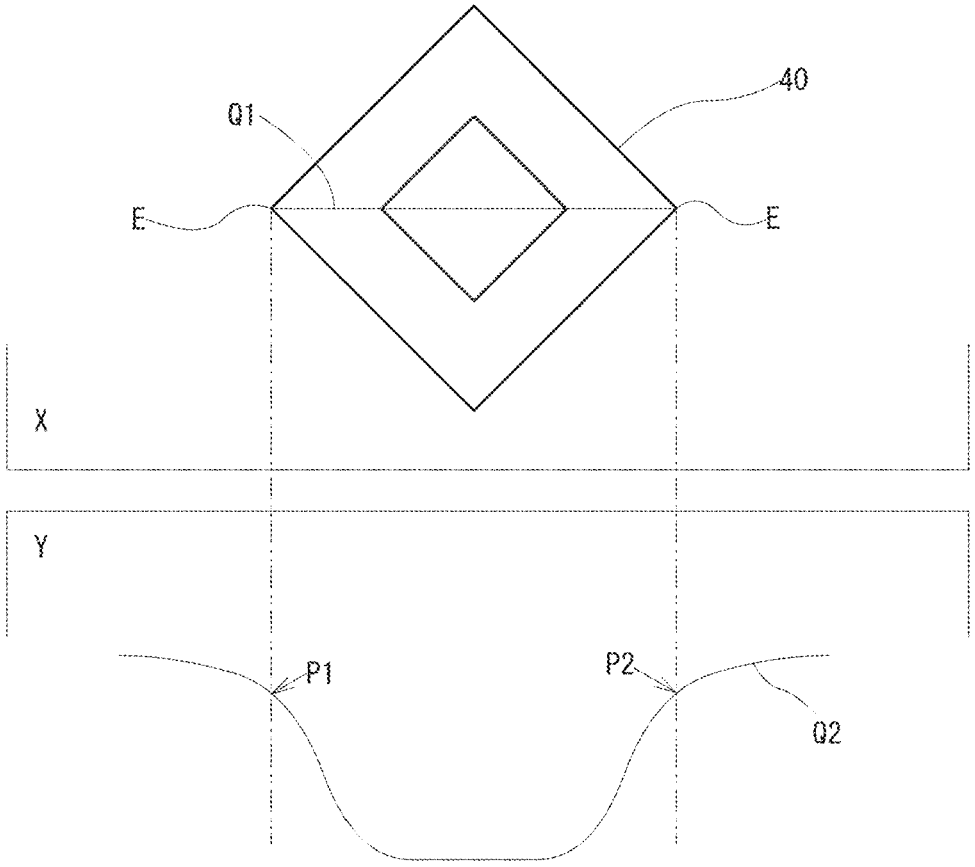
FIG. 2 is a schematic view for explaining a procedure for measuring the depth of the embossment according to the present invention.

The depth of embossing is measured by a one-shot 3D measurement macroscope VR-3200 manufactured by KEYENCE CORPORATION or its equivalent machine, and image analysis software "VR-H1A" or its equivalent software. Measurement is performed under conditions of a magnification of 12 times and a visual field area of 24 mm×18 mm. However, the magnification and the visual field area can be appropriately changed depending on the size of an embossment (concave). A specific measurement procedure will be described with reference to FIG. 2. Using the above software, an embossment depth (measurement cross-sectional curve) profile at a line segment Q1 crossing the longest portion of a peripheral edge of one embossment (concave) 40 in an image portion (X portion in the drawing) illustrated by a plane viewpoint is obtained. A "contour curve Q2" of an image portion (Y portion in the drawing) illustrated by a cross-sectional viewpoint is obtained by removing a component of surface roughness having a shorter wavelength than λc: 800 μm (provided that λc is the "filter that defines a boundary between a roughness component and a waviness component" described in JIS-B0601 "3.1.1.2") from the cross-sectional curve of this embossment depth profile with a low pass filter. In this contour curve Q2, a minimum value sandwiched between two concave edge points P1 and P2 that are protruding upward and have the strongest bend and concave edge points P1 and P2 is determined and defined as a minimum depth value Min. Furthermore, an average value of the depth values of the concave edge points P1 and P2 is defined as a maximum depth value Max. In this way, embossment depth=maximum value Max−minimum value Min. In addition, a distance (length) between the concave edge points P1 and P2 on the X-Y plane is defined as the length of the longest portion. The above two concave edge points P1 and P2 that are protruding upward and have the strongest bend are visually selected. Note that for the selection, a contour E in the image illustrated by a plane viewpoint of the embossment (concave) 40 during the measurement may be referred to. Similarly, the depth of an embossment (concave) is measured for the shortest portion in a direction perpendicular to the longest portion, and a larger value is adopted as the depth of the embossment (concave). The above measurement is performed for any 10 embossments on a surface of the toilet paper, and an average value thereof is defined as a final embossment depth.

Note that also for the area of each concave of the emboss pattern, a contour of an embossment concave is visually confirmed from a 3D image obtained by measurement with a one-shot 3D measurement macroscope VR-3200 or its equivalent machine and image analysis software "VR-H1A" or its equivalent software, and an area inside the contour is measured. The above measurement is performed for any 10 embossments on a surface of the toilet paper, and an average value thereof is defined as a final area of the embossment concave.

It is desirable that the toilet paper according to the present invention has an arithmetic mean curvature (Spc) of 5.0 to 6.5 (1/mm) at a peak of an outer surface thereof under no pressure. Measurement under no pressure means that measurement is performed in a generated state. The arithmetic mean curvature at a peak represents an arithmetic mean of principal curvatures at a peak in a defined region. The smaller the numerical value, the more rounded a point in contact with another object, and the larger the numerical value, the sharper a point in contact with another object. When the arithmetic mean curvature (Spc (1)) at a peak of an outer surface under no pressure is 5.0 to 6.5 (1/mm), a favorable surface property and an excellent wiping property are provided.

The "arithmetic mean curvature (Spc) at a peak" according to the present invention is a value measured using a "one-shot 3D shape measuring machine VR-3200 (manufactured by KEYENCE CORPORATION)" (hereinafter, also referred to as "3D microscope") and its equivalent machine (non-contact three-dimensional measuring device). In the "3D microscope", an object is irradiated with structured illumination light emitted from a light projecting unit, and a fringe projection image of the object is imaged by a monochrome C-MOS camera to obtain a fringe projection image data from which a shape of the object is measured. In particular, the height, length, angle, volume, and the like of any part can be measured using the obtained fringe projection image data. For observing, measuring, and analyzing an image obtained by the "3D microscope", software "VR-H2A" and its equivalent software can be used. Note that measurement is performed under conditions of a visual field area of 24 mm×18 mm and a magnification of 12 times.

A specific procedure for measuring the arithmetic mean curvature (Spc) at a peak under no pressure is as follows. A toilet paper in a form of a ply, which is a test piece having a size of about 50 mm in MD (Machine Direction) and 50 mm in CD (Cross Direction), is placed on a measuring table in a generated state while the measuring machine is in front of the toilet paper and a depth direction is MD. Note that the test piece used for measurement is a flat portion of a product without creases. The test piece is set on the measuring table such that a region without an embossment or a wrinkle is at the center of a field of view. This is for preventing presence of an embossment or a wrinkle in a measurement region. This setting is performed by referring to a field of view displayed on a monitor either visually or via software.

Figure 3:
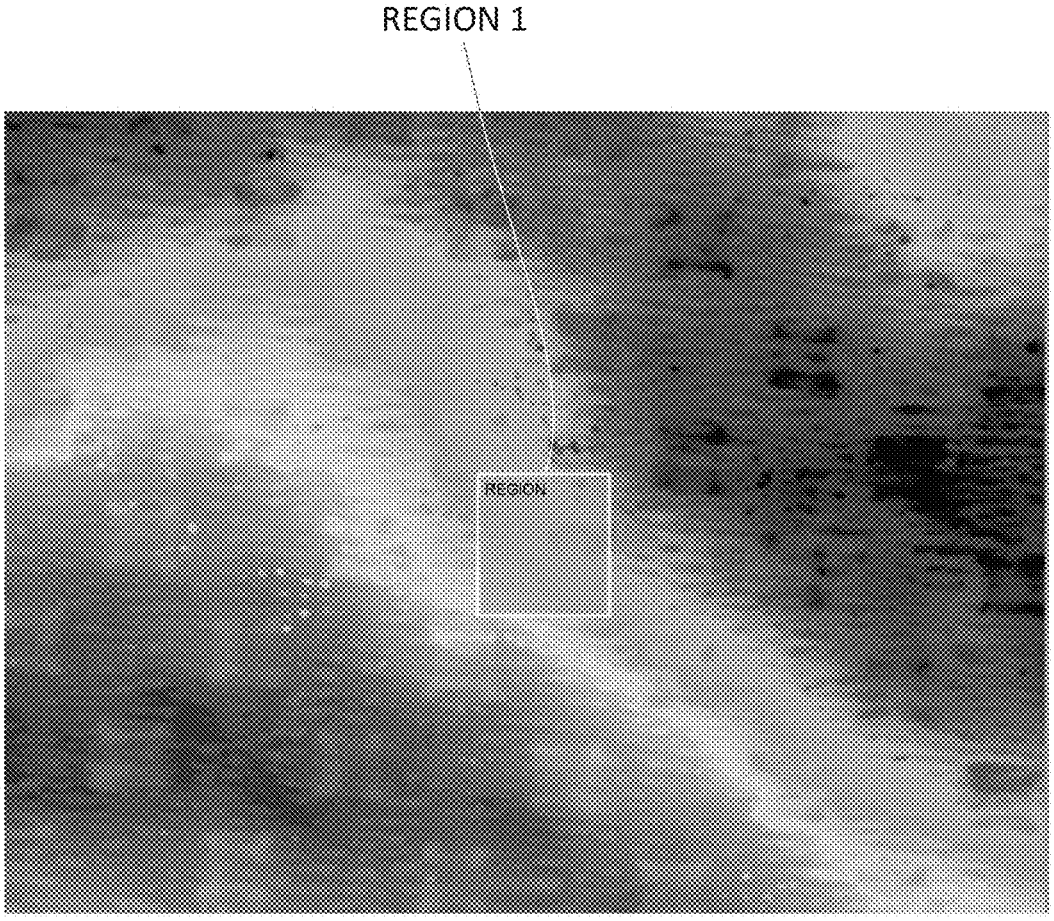
FIG. 3 is a schematic view for explaining measurement of an arithmetic mean curvature according to the present invention.

Next, using software ("VR-H2A"), a profile of a surface of the test piece is captured. At this time, three images of a main image (texture), a main image (height), and a 3D image are obtained. Next, "surface roughness" is measured using the software. At this time, it is desirable to display a "height" image (an image represented by shades of color tones color-coded in the height direction) as illustrated in FIG. 3. Note that in FIG. 3, the "height" image is indicated by grayscale, but the actually obtained "height" image is an image indicated by shades of color tones that are color-coded in the height direction.

Next, a maximum height (Sz) and an arithmetic mean curvature (Spc) at a peak are set, and measurement is performed. The size of the measurement range is 3.000 mm×3.000 mm. With the above software, the measurement range can be set by selecting "Designate numerical value" in "Add region".

Measurement is performed such that a measurement point is approximately at the center of the obtained image. Being approximately at the center is sufficiently satisfied if the measurement point is within a range of 10.0 mm×10.0 mm from the center of the image. Measurement is performed at this point because the test piece is set so as not to include an embossed or wrinkled portion, this point has fewer corrections and higher accuracy than an edge, and intentional selection for a measurement point after checking a height image is eliminated.

The measured value of arithmetic mean curvature (Spc) at a peak is checked, and when a maximum height (Sz) thereof exceeds 0.6 mm, the value is discarded, and measurement is performed again with another test piece. Note that as for measurement conditions, a Gaussian filter is used, no shape correction is performed, a low-pass filter or a high-pass filter is not used, and edge correction is performed. No image preprocessing is performed.

This plane roughness measurement is performed a total of 5 times with different test pieces, and an average of the five measured values is defined as a measured value of arithmetic mean curvature (Spc) at a peak of the measurement sample.

It is desirable that the toilet paper according to the present invention contains pulp fibers that is not unbeaten. It is desirable that the beating degree of a papermaking raw material during manufacturing is not necessarily limited, but it is desirable to beat the papermaking raw material such that a down width of the Canadian standard freeness is 20 cc to 50 cc. This down width is much smaller than the beating width of a general papermaking raw material. In this case, the Canadian standard freeness of the papermaking raw material is approximately 600 cc or more. By preventing the pulp fibers from being beaten too much and preventing the pulp fibers from being unbeaten in this way, the softener is easily fixed to surfaces of the fibers when the softener is internally added so as to be contained, and the fibers are moderately entangled with each other. A small desired paper thickness is easily obtained, excellent softness is achieved, and a favorable fullness is provided. Moreover, paper dust is extremely unlikely to be generated. The paper thickness can be further adjusted with a crepe ratio.

It is desirable that the toilet paper according to the present invention has water-disintegrability of 10 seconds or less. If the toilet paper contains softwood-derived pulp in an amount of 80% by mass or more, particularly 100% by mass of the above constituent fibers, and is furthermore within the range of disintegration freeness, water-disintegrability can be sufficiently within 10 seconds. If water-disintegrability is within 10 seconds, a risk of clogging a pipe is remarkably reduced when the toilet paper is discarded into running water in a flush toilet or the like. This water-disintegrability (easiness of loosening) is measured according to JIS P 4501 (1993). In a test for easiness of loosening, a 300 mL beaker containing 300 mL of water (water temperature 20±5° C.) is placed on a magnetic stirrer, and the rotation speed of a rotor is adjusted to 600±10 revolutions/minute. A test piece of a 100±2 mm square is put into the beaker, and a stopwatch is pressed. The rotation speed of the rotor once drops to about 500 revolutions due to a resistance of the test piece, and rises as the test piece is loosened. When this rotation speed recovers to 540 revolutions, the stopwatch is stopped, and the time is measured in units of one second. A result of easiness of loosening is expressed by an average of results of five tests. The rotor has a disk shape having a diameter of 35 mm and a thickness of 12 mm.

It is desirable that the toilet paper according to the present invention has a dry tensile strength in MD (Machine Direction) of 500 cN/25 mm or more and 1100 cN/25 mm or less, more preferably 600 cN/25 mm or more and 1000 cN/25 mm or less. It is desirable that the toilet paper according to the present invention has a lateral dry tensile strength of 200 cN/25 mm or more and 450 cN/25 mm or less, more preferably 200 cN/25 mm or more and 350 cN/25 mm or less. If the dry tensile strength is within this range, the toilet paper is sufficiently durable for use.

Note that the longitudinal direction of paper is also referred to as MD (Machine Direction) and is a flow direction during papermaking. The lateral direction of paper is also referred to as CD (Cross Direction), and is a direction perpendicular to a flow direction (MD) during papermaking. The dry tensile strength according to the present invention is a value measured based on JIS P 8113 (2006), and is measured as follows. As a test piece, a tissue paper cut into a size of about 25 mm (±0.5 mm) (width)×about 150 mm (length) in both MD and CD is used. The test piece is measured in a state of multiple plies. As a tester, a load cell tensile tester TG-200N manufactured by Minebea Co., Ltd. and its equivalent machine are used. Note that a grip interval is set to 100 mm, and a tensile speed is set to 100 mm/min. The measurement is performed by tightening both ends of the test piece to a grip of the tester, applying a tensile load to the paper piece in an up-down direction, and reading an indicated value (a digital value when the value is indicated by the digital value) when the paper breaks. Five sets of samples are prepared in each of MD and CD, and each sample is measured five times. An average of the measured values is defined as a dry tensile strength in each of the directions.

It is desirable that the toilet paper according to the present invention has a wet tensile strength in MD of 50 cN/25 mm or more and 100 cN/25 mm or less. It is desirable that the toilet paper according to the present invention has a wet tensile strength in CD of 25 cN/25 mm or more and 50 cN/25 mm or less. The wet tensile strength is a value measured based on JIS P 8135 (1998), and is measured as follows. As a test piece, a tissue paper cut into a size of about 25 mm (±0.5 mm) (width)×about 150 mm (length) in both MD and CD is used. A multi-ply tissue paper is measured in a state of multiple plies. As a tester, a load cell tensile tester TG-200N manufactured by Minebea Co., Ltd. and its equivalent machine are used. Note that a grip interval is set to 100 mm, and a tensile speed is set to 50 mm/min. The test piece used has been cured for 10 minutes in a dryer at 105° C. The measurement is performed by tightening both ends of the test piece to a grip of the tester, then horizontally imparting water to a central portion of the test piece with a width of about 10 mm using a flat brush containing water, immediately thereafter applying a tensile load to the paper piece in an up-down direction, and reading an indicated value (digital value) when the paper breaks. Five sets of samples are prepared in each of MD and CD, and each sample is measured five times. An average of the measured values is defined as a wet tensile strength in each of the directions. Wet tensile strength was also measured in a stack of a plurality of sheets according to the number of plies of a product.

It is desirable that the toilet paper according to the present invention has an MMD value of 7.5 or more and 11.0 or less, which is an indicator indicating a surface property. When the MMD is less than 7.5, the surface is too smooth, and a wiping property deteriorates. When the MMD exceeds 11.0, the toilet paper may have poor touch and may be unsuitable for use as a toilet paper. Note that for measuring MMD, a surface to be used is measured in a state of multiple plies of the product. While a contact surface of a friction element is brought into contact with a surface of a measurement sample to which a tension of 20 g/cm is applied in a predetermined direction at a contact pressure of 25 g, the measurement sample is moved by 2 cm in substantially the same direction as the direction in which the tension is applied at a speed of 0.1 cm/s, and a friction coefficient at this time is measured using a friction sense tester KES-SE (manufactured by Kato Tech Co., Ltd.) or its equivalent machine. A value obtained by dividing the friction coefficient by a friction distance (moving distance=2 cm) is MMD. The friction element is formed by adjoining 20 piano wires P each having a diameter of 0.5 mm, and has a contact surface formed such that the length and the width are both 10 mm. On the contact surface, a unit bulging portion having a tip formed with 20 piano wires P (radius of curvature: 0.25 mm) is formed.

It is desirable that the toilet paper of the present embodiment has Softness of 2.0 cN/100 mm or more and 3.5 cN/100 mm or less. Softness is one of indicators of softness, in which paper is softer as the paper has a lower value of Softness. A tissue paper or a toilet paper having Softness of 3.5 cN/100 mm or less is evaluated to be soft. Softness is a value measured based on a handle-o-meter method according to the JIS L 1096 E method (1990). However, a test piece has a size of 100 nm×100 mm, and a clearance is set to 5 mm. A 1-ply product is measured five times in each of MD and CD, and an average of the total 10 values is defined as Softness. Softness is unitless, but may be expressed in units of cN/100 mm considering the size of a test piece.

In the toilet paper according to the present embodiment, the dry tensile strength and the wet tensile strength can be adjusted without using a paper strength agent such as a dry paper strength enhancer or a wet paper strength enhancer or a sizing agent. In particular, it is desirable that the toilet paper contains no paper strength agent or sizing agent from a viewpoint of a user's security feeling and water-disintegrability. By blending a large amount (80% by mass or more, particularly 100 k by mass) of softwood pulp having a long fiber length and further containing a softener in the toilet paper according to the present invention, the long fiber is soft, moderate entanglement between the fibers is ensured, and sufficient strength for use can be achieved even if the toilet paper contains no paper strength agent. When the pulp contains lignin, better water-disintegrability is achieved. That is, sufficient strength can be ensured without using a paper strength agent, and better water-disintegrability can be achieved.

Note that it is desirable that the toilet paper according to the present invention does not use a dry paper strength enhancer or a wet paper strength enhancer as described above, but the toilet paper may use the dry paper strength enhancer or the wet paper strength enhancer as necessary as long as water-disintegrability is not impaired. Examples of the dry paper strength enhancer here include starch, polyacrylamide, and carboxymethyl cellulose (CMC) or salt thereof such as sodium carboxymethyl cellulose, calcium carboxymethyl cellulose and zinc carboxymethyl cellulose.

Examples of the wet paper strength enhancer include a polyamide polyamine epichlorohydrin resin, a urea resin, an acid colloid/melamine resin, heat-crosslinkable coating PAM, TS-20 manufactured by Seiko PMC Corporation, a polymer aldehyde-functional compound such as glioxylated polyacrylamide and cationic glioxylated polyacrylamide, a copolymer of an acrylamide monomer modified with a divalent aldehyde of glyoxal and another copolymerizable unsaturated monomer, and dialdehyde starch.

On the other hand, the toilet paper according to the present invention can be manufactured by a known papermaking technique and stacking technique for forming a ply structure except for the preparation of the above papermaking raw material, specifically except that a fiber raw material containing 80% by mass or more of softwood pulp is used, unbeaten or low beaten fibers are used such that the Canadian standard freeness of the papermaking raw material is approximately 600 cc or more, and a predetermined amount of a softener is added.

Figure 4:
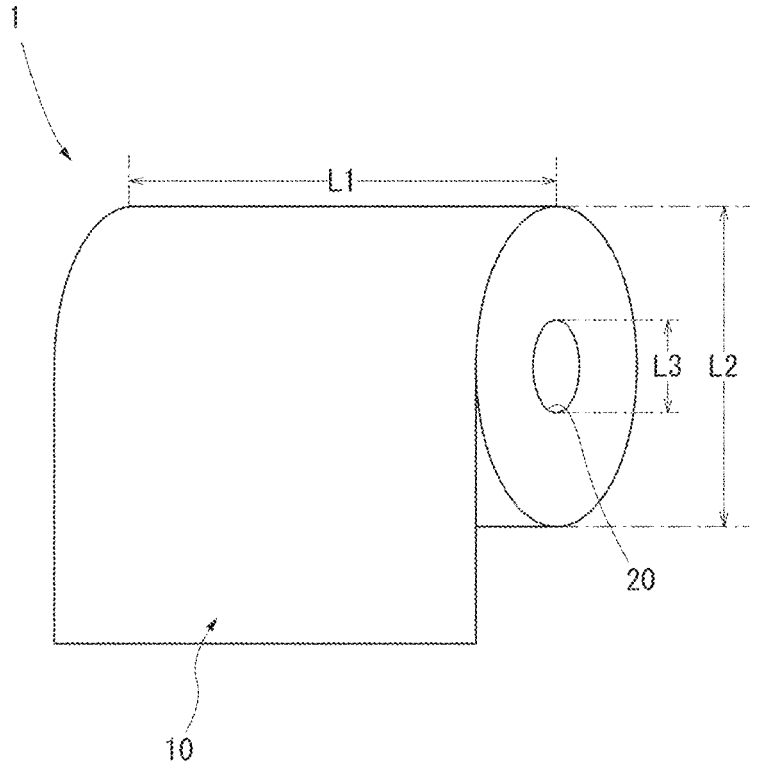
FIG. 4 is a perspective view of a toilet roll according to an embodiment of the present invention.

On the other hand, the toilet paper according to the present invention may have a sheet-like shape. However, as illustrated in FIG. 4, the toilet paper is suitably in a form of a toilet roll obtained by winding a belt-shaped toilet paper 10 around a paper tube (also referred to as a tube core) 20 into a roll shape.

It is desirable that the toilet roll according to the present invention has a winding diameter L2 (diameter) of 110 to 115 mm. The winding diameter of the toilet roll is defined as 120 mm or less in JIS P 4501, and a holder for setting a general toilet roll is created based on this 120 mm. The toilet roll of the present invention has a winding diameter of 110 to 115 mm, and has a size that can be sufficiently set in a general holder. Here, the winding diameter is a value measured using a diameter rule manufactured by Muratec KDS Corporation or its equivalent machine. An average of measured values at three different locations in a width direction is used as a measured value. Note that an average value for five rolls is used as an average value for products in the same manufacturing lot.

Meanwhile, it is desirable that the toilet roll has a winding length of 20 to 40 m and a winding density of 0.20 to 0.30 m/cm$^2$ at this time. The winding density here is a value calculated by winding length (m)/actual cross-sectional area. The actual cross-sectional area is a value calculated by {(winding diameter/2)×(winding diameter/2)×π−(paper tube outer diameter/2)×(paper tube outer diameter/2)×π} (unit: cm$^2$). That is, the actual cross-sectional area is an area obtained by subtracting the area of the paper tube on an opening end side from the area of an end surface. In the above roll form, the toilet paper according to the present invention remarkably provides softness when the roll is held in the hand on a peripheral surface thereof when the toilet paper has a winding density of 0.24 to 0.28 m/cm$^2$, which is more desirable. Note it is desirable that a paper tube outer diameter (paper tube diameter) L3 is 35 to 45 min, which is similar to a general size.

It is desirable that the toilet paper of the present invention has a roll winding tightness of 1.8 to 3.0 mm. A "handy compression tester KES-G5" manufactured by Kato Tech Co., Ltd. is used to measure the roll winding tightness (mm) (T0−TM). A toilet roll TR is placed horizontally on a horizontal pedestal made of a steel plate such that a central axis of the toilet roll TR is horizontal. A steel plate terminal having a circular plane with a compression area of 2 cm$^2$ is brought into contact with the center of an upper surface of an outer periphery of a roll trunk. With this contacted state as a zero point, the steel plate terminal is moved vertically downward at a speed of 10 mm/min from the zero point to compress the toilet roll. (T0 −TM) (mm) is defined as a roll winding tightness (mm), in which T0 (mm) represents the amount of pushing when a compression load is 0.5 gf/cm$^2$, and TM (mm) represents the amount of pushing when the compression load is 50 gf/cm$^2$. The larger the roll winding tightness (mm), the larger a pushing depth at the time of pushing at a maximum load of 50 gf/cm$^2$, which indicates that the paper is fluffy. That is, this corresponds to a fullness. Note that the above winding length and winding density can sufficiently provide the winding tightness.

Furthermore, it is desirable that the toilet roll of the present invention has a compression work amount (WC) of 3.5 to 5.5 gf-cm/cm$^2$. The compression work amount (WC) is a work amount from a time point when a steel plate terminal is brought into contact with a roll at 0.5 gf/cm$^2$ to a time point of pushing at a maximum load of 50 gf/cm$^2$. The larger the compression work amount (WC), the weaker a repulsive force at an initial stage of pushing. Therefore, at a moment when the roll is grabbed, the roll is felt to be soft. Thereafter, when the compression load is raised to 50 gf/cm$^2$ at which the roll is usually grabbed, the roll can be evaluated to be soft and fluffy.

The toilet paper according to the present invention contains softwood-derived pulp having a long fiber length in an amount of 80% by mass of fibers. Furthermore, it is most preferable that the toilet paper contains NOKP in an amount of 80, by mass of fibers, and a bond between the fibers is moderately weak. Therefore, when the toilet paper is formed into the above roll form, the toilet paper has an excellent cushioning property, and softness is easily felt when the toilet paper is held in the hand as described above.

Hereinafter, the effect of the toilet paper according to the present invention will be further described with reference to Examples.

EXAMPLES

Next, for Examples, and Comparative Examples relating to the toilet paper of the present invention, sensory evaluation was performed on "wiping property during use", "security feeling during use", "fullness and thick feeling during use", "tear and strength during use", and "water-disintegrability during use".

The structure of the toilet roll and the physical properties and composition of the toilet paper according to each example are illustrated in Table 1 below. Comparative Examples 1 and 2 each contain a large amount of hardwood-derived pulp, and Comparative Examples 3 to 5 are each a 3-ply or 4-ply commercial product, and each contain pulp other than pulp fibers as a main raw material. Comparative Example 1 has a fiber structure containing 65% by mass of LBKP and 35% by mass of NBKP, and has a fiber structure and a softener amount of a generally commercially available toilet paper. In Comparative Example 2, a ratio between hardwood-derived pulp and softwood-derived pulp is similar to that in Comparative Example 1, but non-chlorine-bleached NOKP and LOKP are contained as a fiber structure. Examples and Comparative Examples 1 and 2 formed embossments of the pattern illustrated in FIG. 1.

For the sensory evaluation, 18 subjects actually used the rolled toilet paper according to each example, and performed relative evaluation on each item of "wiping property during use", "security feeling during use", "fullness and thick feeling during use", "tear and strength during use", and "water-disintegrability during use" based on the toilet paper having a general fiber structure in Comparative Example 1. In the evaluation, Comparative Example 1 was evaluated as 4 points (median), and scoring was performed from 7 points for a good evaluation to 1 point for a poor evaluation with a difference for one point up or down, and an average value thereof was calculated for judgement.

TABLE 1

| | | | | Example 1 | Example 2 | Example 3 | Example 4 | Example 5 |
|---|---|---|---|---|---|---|---|---|
| Papermaking | Softwood pulp | NUKP | % | | | | | |
| | | NOKP | | | | 100 | 100 | 100 |
| | | NBKP | | 100 | 90 | | | |
| | Hardwood pulp | LUKP | | | | | | |
| | | LOKP | | | | | | |
| | | LBKP | | | 10 | | | |
| | Raw material freeness | CSF | cc | (Unbeaten) 680 | 640 | 640 | 640 | (Unbeaten) 680 |
| | Softener | Cationic fatty acid amide-based softener | kg/T | 1.4 | 1.4 | 0.85 | 0.85 | 1.4 |
| | | Softening moisturizer | kg/T | 0.5 | 0.5 | 0.5 | 0.5 | 0.5 |
| Product | Basis weight | Single ply | $g/m^2$ | 15.2 | 14.8 | 11.0 | 12.0 | 13.3 |
| | Paper thickness | Single ply | μm | 138 | 134 | 86 | 91 | 121 |
| | | Total plies | μm | 552 | 537 | 343 | 364 | 483 |
| | Number of plies | | Sheet | 4 | 4 | 4 | 4 | 4 |
| | Dry tensile strength | Product, MD | cN/25 mm | 739 | 720 | 767 | 897 | 647 |
| | Dry tensile strength | Product, CD | cN/25 mm | 376 | 366 | 261 | 298 | 329 |
| | Softness | Single ply | cN/100 mm | 2.6 | 2.5 | 2.6 | 3.2 | 2.0 |
| | MMD | 3-ply or 4-ply (Product) | 1/100 | 9.1 | 8.7 | 9.5 | 9.5 | 8.9 |
| | Water-disintegrability | 10 cm × 10 cm Total plies | Second | 10 | 10 | 8.5 | 8.5 | 8 |
| | Disintegration freeness | CSF | cc | 660 | 620 | 620 | 630 | 660 |
| | Winding length | | m | 23.0 | 23.0 | 26 | 26 | 23.0 |
| | Winding diameter | | mm | 116 | 117 | 117 | 117 | 116 |
| | Paper tube diameter | | mm | 41 | 41 | 41 | 41 | 41 |
| | Winding density | | m/cm2 | 0.25 | 0.24 | 0.27 | 0.28 | 0.25 |
| | Roll width | | mm | 104 | 104 | 104 | 104 | 104 |
| | Roll density | | g/cm3 | 0.134 | 0.134 | 0.121 | 0.133 | 0.118 |
| | Depth of entire surface embossing | | mm | 0.2006 | 0.1865 | 0.2041 | 0.1985 | 0.1908 |
| Roll compression property | Winding tightness (roll) 0.5-50 gf/cm2 | | mm | 2.12 | 2.10 | 2.60 | 2.22 | 2.11 |
| | LC (Compression straightness) | | — | 0.79 | 0.78 | 0.79 | 0.77 | 0.80 |
| | WC (Compression work amount) | | gf · cm/cm2 | 4.12 | 4.02 | 5.25 | 4.49 | 4.33 |
| | RC (Compression recovery) | | % | 49.1 | 48.1 | 46.3 | 47.6 | 48.4 |
| | Surface property Spc Arithmetic mean curvature at peak | | 1/mm | 5.47 | 5.55 | 6.10 | 5.89 | 6.36 |
| Sensory evaluation | Wiping property during use | | 1 to 7 | 5.6 | 5.7 | 5.8 | 5.5 | 6.2 |
| | Security feeling during use | | 1 to 7 | 5.7 | 5.6 | 5.4 | 5.4 | 6.2 |
| | Fullness and thick feeling during use | | 1 to 7 | 5.5 | 5.6 | 5.3 | 5.2 | 5.7 |
| | Tear and strength during use | | 1 to 7 | 6.2 | 6.1 | 6.5 | 6.6 | 6.1 |
| | Water-disintegrability during use | | 1 to 7 | 5.8 | 5.6 | 6.1 | 6.0 | 6.3 |

| | | | | Example 6 | Example 7 | Example 8 | Comparative Example 1 |
|---|---|---|---|---|---|---|---|
| Papermaking | Softwood pulp | NUKP | % | | | | |
| | | NOKP | | 85 | 100 | 90 | |
| | | NBKP | | | | | 35 |
| | Hardwood pulp | LUKP | | | | | |
| | | LOKP | | 15 | | 10 | |
| | | LBKP | | | | | 65 |
| | Raw material freeness | CSF | cc | (Unbeaten) 700 | (Unbeaten) 690 | (Unbeaten) 680 | 430 |
| | Softener | Cationic fatty acid amide-based softener | kg/T | 1.4 | 1.4 | 1.4 | 0.85 |
| | | Softening moisturizer | kg/T | 0.5 | 0.5 | 0.5 | 0.5 |

TABLE 1-continued

| | | | | | | | |
|---|---|---|---|---|---|---|---|
| Product | Basis weight | Single ply | $g/m^2$ | 12.9 | 15.6 | 16.0 | 15.0 |
| | Paper thickness | Single ply | μm | 117 | 142 | 145 | 136 |
| | | Total plies | μm | 468 | 425 | 436 | 545 |
| | Number of plies | | Sheet | 4 | 3 | 3 | 4 |
| | Dry tensile strength | Product, MD | cN/25 mm | 627 | 758 | 778 | 729 |
| | Dry tensile strength | Product, CD | cN/25 mm | 319 | 386 | 396 | 371 |
| | Softness | Single ply | cN/100 mm | 1.9 | 2.7 | 2.9 | 2.5 |
| | MMD | 3-ply or 4-ply (Product) | 1/100 | 8.6 | 8.8 | 8.6 | 7.0 |
| | Water-disintegrability | 10 cm × 10 cm Total plies | Second | 6 | 8 | 6 | 17 |
| | Disintegration freeness | CSF | cc | 670 | 660 | 660 | 400 |
| | Winding length | | m | 23.0 | 30.6 | 30.6 | 23.0 |
| | Winding diameter | | mm | 117 | 117 | 117 | 117 |
| | Paper tube diameter | | mm | 41 | 41 | 41 | 41 |
| | Winding density | | m/cm2 | 0.24 | 0.24 | 0.24 | 0.24 |
| | Roll width | | mm | 104 | 104 | 104 | 104 |
| | Roll density | | g/cm3 | 0.116 | 0.140 | 0.144 | 0.135 |
| | Depth of entire surface embossing | | mm | 0.2074 | 0.2064 | 0.2113 | 0.1852 |
| Roll compression property | Winding tightness (roll) 0.5-50 gf/cm2 | | mm | 2.06 | 2.12 | 2.16 | 1.60 |
| | LC (Compression straightness) | | — | 0.76 | 0.82 | 0.80 | 0.79 |
| | WC (Compression work amount) | | gf · cm/cm2 | 4.39 | 4.29 | 4.35 | 3.16 |
| | RC (Compression recovery) | | % | 47.7 | 47.3 | 51.2 | 44.9 |
| | Surface property Spc Arithmetic mean curvature at peak | | 1/mm | 6.11 | 6.02 | 6.11 | 4.26 |
| Sensory evaluation | Wiping property during use | | 1 to 7 | 6.1 | 6.3 | 6.1 | 4.0 |
| | Security feeling during use | | 1 to 7 | 6.3 | 6.0 | 6.1 | 4.0 |
| | Fullness and thick feeling during use | | 1 to 7 | 5.5 | 5.4 | 5.6 | 4.0 |
| | Tear and strength during use | | 1 to 7 | 6.3 | 6.5 | 6.3 | 4.0 |
| | Water-disintegrability during use | | 1 to 7 | 6.4 | 6.3 | 6.2 | 4.0 |

| | | | | Comparative Example 2 | Comparative Example 3 | Comparativa Example 4 | Comparative Example 5 |
|---|---|---|---|---|---|---|---|
| Papermaking | Softwood pulp | NUKP | % | | Wood pulp | Straw pulp | Bamboo pulp |
| | | NOKP | | 35 | | | |
| | | NBKP | | | | | |
| | Hardwood pulp | LUKP | | | | | |
| | | LOKP | | 65 | | | |
| | | LBKP | | | | | |
| | Raw material freeness | CSF | cc | 430 | — | — | — |
| | Softener | Cationic fatty acid amide-based softener | kg/T | 0.85 | — | — | — |
| | | Softening moisturizer | kg/T | 0.5 | — | — | — |
| Product | Basis weight | Single ply | $g/m^2$ | 13.1 | 15.4 | 15.5 | 15.1 |
| | Paper thickness | Single ply | μm | 119 | 92 | 105 | 96 |
| | | Total plies | μm | 357 | 367 | 315 | 287 |
| | Number of plies | | Sheet | 3 | 4 | 3 | 3 |
| | Dry tensile strength | Product, MD | cN/25 mm | 637 | 763 | 579 | 1397 |
| | Dry tensile strength | Product, CD | cN/25 mm | 324 | 393 | 461 | 364 |
| | Softness | Single ply | cN/100 mm | 1.9 | 3.6 | 3.5 | 4.9 |
| | MMD | 3-ply or 4-ply (Product) | 1/100 | 7.2 | 12.1 | 13.5 | 15.3 |
| | Water-disintegrability | 10 cm × 10 cm Total plies | Second | 15 | 108 | 49 | Unmeasurable (large) |
| | Disintegration freeness | CSF | cc | 410 | 180 | 260 | 120 |
| | Winding length | | m | 30.6 | 24.0 | 22.9 | 32.0 |
| | Winding diameter | | mm | 117 | 104 | 103 | 104 |
| | Paper tube diameter | | mm | 41 | 43 | 41 | 40 |
| | Winding density | | m/cm2 | 0.24 | 0.34 | 0.24 | 0.33 |
| | Roll width | | mm | 104 | 108 | 95 | 102 |
| | Roll density | | g/cm3 | 0.118 | 0.112 | 0.071 | 0.107 |
| | Depth of entire surface embossing | | mm | 0.1916 | — | — | 0.3448 |
| Roll compression property | Winding tightness (roll) 0.5-50 gf/cm2 | | mm | 1.67 | 0.64 | 0.54 | 0.52 |
| | LC (Compression straightness) | | — | 0.80 | 0.68 | 0.72 | 0.75 |
| | WC (Compression work amount) | | gf · cm/cm2 | 3.31 | 1.09 | 0.96 | 0.97 |
| | RC (Compression recovery) | | % | 44.4 | 50.4 | 52.9 | 51.2 |
| | Surface property Spc Arithmetic mean curvature at peak | | 1/mm | 4.41 | 4.23 | 4.11 | 4.51 |

TABLE 1-continued

| | | | | | | |
|---|---|---|---|---|---|---|
| Sensory evaluation | Wiping property during use | 1 to 7 | 4.1 | 3.3 | 3.1 | 2.8 |
| | Security feeling during use | 1 to 7 | 4.3 | 4.5 | 3.1 | 3.2 |
| | Fullness and thick feeling during use | 1 to 7 | 4.1 | 4.1 | 2.7 | 3.8 |
| | Tear and strength during use | 1 to 7 | 3.9 | 4.5 | 2.5 | 4.5 |
| | Water-disintegrability during use | 1 to 7 | 4.2 | 2.1 | 2.5 | 1.2 |

Examples according to the present invention each had a higher disintegration freeness and obtained much better sensory evaluation results for all the items in the sensory evaluation than Comparative Examples 1 and 2. In addition, Examples according to the present invention show much better sensory evaluation results for all the items than the commercially available products.

In the form of the toilet roll, in Examples of the present invention, the compression work amount was larger than that in Comparative Examples, and more softness was felt when the toilet paper in the roll form was held in the hand.

In addition, Examples each had a shallower depth of embossing than Comparative Example 5, but had an excellent wiping property. In addition, as compared with Comparative Examples, Examples each had slightly higher values of surface property (Spc) and MMD than Comparative Examples due to unbeaten or low beaten softwood-derived pulp, which enhances the wiping property.

As described above, the toilet paper according to the present invention provides a thick feeling that can make a user reassured during use thereof in a shower toilet, has sufficient softness, improves a wiping property, and has excellent water-disintegrability.

REFERENCE SIGNS LIST

1 Toilet roll
10 Toilet paper
20 Paper tube (tube core)
L1 Width of toilet roll
L2 Winding diameter (diameter) of toilet roll
L3 Diameter (outer diameter) of tube core of toilet roll
31, 32 Concave
33 Valley line portion

The invention claimed is:

1. A 3-ply or 4-ply toilet paper, comprising:
softwood-derived pulp in an amount of 80% by mass or more of fibers; and
a cationic fatty acid amide-based softener,
wherein the toilet paper has concaves formed by embossing,
wherein the toilet paper is a 4-ply double embossment formed by 2-ply stacked single embossed sheet, or an embossment formed by combining a 2-ply stacked single embossed sheet and a 1-ply embossed sheet,
wherein an area of each concave is 1.0 to 2.5 $mm^2$, a density of the concaves is 5.0 to 50 concaves per square centimeter of the toilet paper, and a depth of each emboss is 0.05 to 0.5 mm,
wherein each ply has a basis weight of 10.5 to 16.5 $g/m^2$ per ply, and
wherein the toilet paper has a disintegration freeness of 550 cc or more as determined by disintegrating the toilet paper and measuring its freeness according to JIS P 8121-2:2012.

2. The toilet paper according to claim 1, comprising 0.5 to 4.0 kg/ one ton of pulp material of the cationic fatty acid amide-based softener.

3. The 3-ply or 4-ply toilet paper according to claim 1,
wherein the cationic fatty acid amide-based softener is contained at 1.0 to 8.0 kg/one ton of pulp material, and
wherein the 3-ply or 4-ply toilet paper is made from a papermaking raw material having a freeness according to JIS P 8121-2:2012 of 600 cc or more.

4. A method for manufacturing a toilet paper, comprising:
performing a papermaking of raw material containing softwood-derived pulp in an amount of 80% by mass or more of fibers and 1.0 to 8.0 kg/pulp t of a cationic fatty acid amide-based softener, and having a freeness according to JIS P 8121-2:2012 of 600 cc or more to obtain a single layer sheet having a basis weight of 10.5 to 16.5 $g/m^2$, and then
performing embossing to obtain at least either of a 2-ply-stacked single-embossed sheet and a 1-ply embossed sheet, wherein the embossing is performed so that an area of each concave is 1.0 to 2.5 $mm^2$, a density of the concaves is 5.0 to 50 concaves per square centimeter of the toilet paper, and a depth of each emboss is 0.05 to 0.5 mm,
stacking the 2-ply-stacked single-embossed sheets, or the 2-ply-stacked single-embossed sheet and the 1-ply embossed sheet, to obtain 3-ply or 4-ply toilet paper.

5. The 3-ply or 4-ply toilet paper according to claim 2,
wherein the cationic fatty acid amide-based softener is contained at 1.0 to 8.0 kg/one ton of pulp material, and
wherein the 3-ply or 4-ply toilet paper is made from a papermaking raw material having a freeness according to JIS P 8121-2:2012 of 600 cc or more.

* * * * *